US010077620B2

(12) United States Patent
Nguyen

(10) Patent No.: US 10,077,620 B2
(45) Date of Patent: Sep. 18, 2018

(54) LOAD SHOULDER SYSTEM

(71) Applicant: Cameron International Corporation, Houston, TX (US)

(72) Inventor: Dennis P. Nguyen, Pearland, TX (US)

(73) Assignee: Cameron International Corporation, Houston, TX (US)

( * ) Notice: Subject to any disclaimer, the term of this patent is extended or adjusted under 35 U.S.C. 154(b) by 151 days.

(21) Appl. No.: 14/498,815

(22) Filed: Sep. 26, 2014

(65) Prior Publication Data

US 2016/0090802 A1 Mar. 31, 2016

(51) Int. Cl.

| | |
|---|---|
| ***E21B 23/02*** | (2006.01) |
| ***E21B 23/03*** | (2006.01) |
| ***E21B 33/04*** | (2006.01) |
| ***E21B 47/09*** | (2012.01) |

(52) U.S. Cl.

CPC ..... *E21B 23/02* (2013.01); *E21B 23/03* (2013.01); *E21B 33/04* (2013.01); *E21B 47/09* (2013.01)

(58) Field of Classification Search

CPC ..... E21B 23/02; E21B 23/03; E21B 33/04
See application file for complete search history.

(56) References Cited

U.S. PATENT DOCUMENTS 3,279,539 A * 10/1966 Brown ..... E21B 33/04 166/115
3,684,016 A * 8/1972 Hull ..... E21B 23/02 166/208
4,018,275 A * 4/1977 Gaut ..... E21B 33/1291 166/137
4,138,144 A * 2/1979 Pierce, Jr. ..... E21B 33/04 277/329
4,249,601 A * 2/1981 White ..... E21B 43/10 166/208
4,681,159 A * 7/1987 Allwin ..... E21B 17/06 166/124
4,712,621 A * 12/1987 Wightman ..... E21B 33/043 166/123
4,714,111 A * 12/1987 Brammer ..... E21B 33/04 166/182
4,722,391 A * 2/1988 Brammer ..... E21B 33/04 166/195
5,080,174 A * 1/1992 Hynes ..... E21B 33/06 166/120
5,456,321 A * 10/1995 Shiach ..... E21B 33/04 166/382
6,209,653 B1 * 4/2001 Pringle ..... E21B 23/02 166/123
6,739,398 B1 * 5/2004 Yokley ..... E21B 23/01 166/123

(Continued)

OTHER PUBLICATIONS

PCT Invitation to Pay Additional Fees; Application No. PCT/US2015/050302; dated Apr. 29, 2016; 6 pages.

(Continued)

*Primary Examiner* — William D Hutton, Jr.
*Assistant Examiner* — Steven A MacDonald
(74) *Attorney, Agent, or Firm* — Fletcher Yoder, P.C.

(57) ABSTRACT

A system including a load shoulder system, including a shoulder setting tool, including a shoulder coupling system configured to couple to a load shoulder, and a shoulder energizing system configured to couple the load shoulder to a tubular of a mineral extraction system.

6 Claims, 7 Drawing Sheets

(56) References Cited

U.S. PATENT DOCUMENTS

| | | | | |
|---|---|---|---|---|
| 8,286,711 | B2 * | 10/2012 | Neto | E21B 33/04 166/123 |
| 8,590,624 | B2 * | 11/2013 | Neto | E21B 33/043 166/336 |
| 8,672,040 | B2 * | 3/2014 | Kobata | E21B 47/09 166/360 |
| 9,217,307 | B2 * | 12/2015 | McCoy, Jr. | E21B 33/043 |
| 9,435,164 | B2 * | 9/2016 | Fenwick | E21B 23/00 |
| 2002/0189806 | A1 | 12/2002 | Davidson et al. | |
| 2009/0126945 | A1 * | 5/2009 | Sharma | E21B 23/02 166/383 |
| 2011/0232920 | A1 | 9/2011 | Nguyen | |
| 2013/0299193 | A1 * | 11/2013 | Duong | E21B 33/04 166/382 |

OTHER PUBLICATIONS

PCT International Search Report and Written Opinion; Application No. PCT/US2015/050302; dated Jul. 25, 2016; 16 pages.

* cited by examiner

LOAD SHOULDER SYSTEM

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

In some drilling and production systems, hangers, such as a tubing hanger, may be used to suspend strings of tubing for various flows in and out of a well. Such hangers may be disposed within a wellhead that supports both the hanger and the string. For example, after drilling, a tubing hanger may be lowered into a wellhead and supported on a ledge or landing within a casing to facilitate the flow of hydrocarbons out of the well. Unfortunately, casings with preformed ledges or landings reduce the size of the bore, which requires either smaller drilling equipment to fit through the bore or larger more expensive casings with larger bores.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The disclosed embodiments include a load shoulder system with a shoulder setting tool and a load shoulder. The load shoulder system enables a wellhead to include casings without a preformed hanger landing. Accordingly, the casing may be smaller while still providing a bore size that accommodates standard drilling equipment. For example, after drilling operations, the shoulder setting tool may lower and couple the load shoulder to the casing, which provides a ledge or landing that can support a hanger, such as a tubing hanger. As will be explained in greater detail below, the shoulder setting tool includes a shoulder coupling system and a shoulder energizing system. Together these systems enable the shoulder setting tool to couple to, energize, and release from the load shoulder. Specifically, the shoulder setting tool uses the shoulder coupling system to couple to the load shoulder. This enables the shoulder setting tool to lower the load shoulder into the wellhead. After insertion into the wellhead, the shoulder setting tool energizes the load shoulder with the shoulder energizing system, which locks the load shoulder within the wellhead. The shoulder coupling system then uncouples from the load shoulder enabling the shoulder setting tool to retract from the wellhead. Accordingly, the load shoulder system enables complete use of the casing bore during drilling operations, while providing a hanger landing for the hanger (e.g., tubing hanger) once drilling operations stop.

Figure 1:
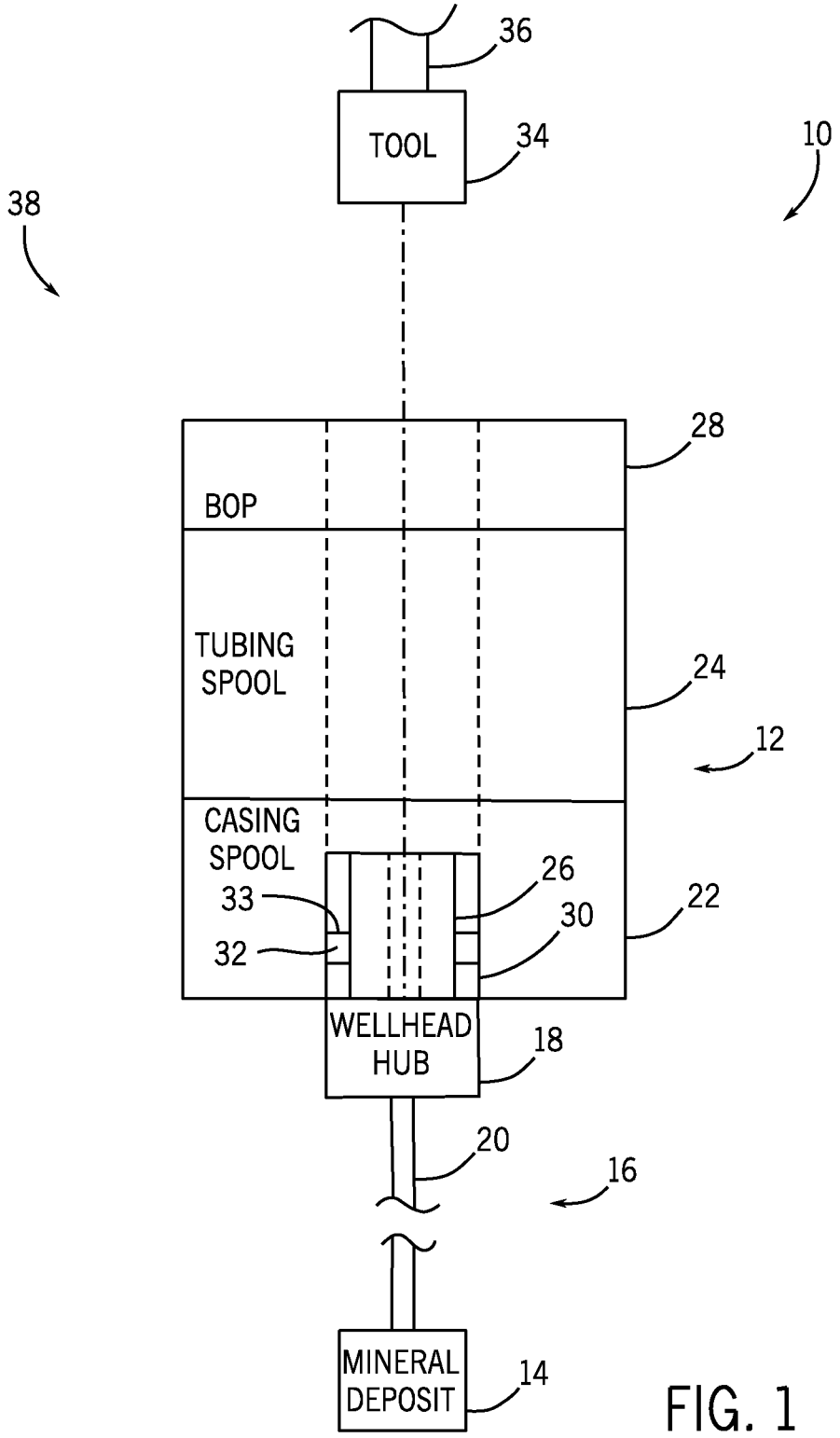
FIG. 1 is a block diagram of an embodiment of a mineral extraction system with a load shoulder.

FIG. 1 is a block diagram that illustrates a mineral extraction system 10 (e.g., hydrocarbon extraction system) that can extract various minerals and natural resources, including hydrocarbons (e.g., oil and/or natural gas) from the earth. In some embodiments, the mineral extraction system 10 is land-based (e.g., a surface system) or subsea (e.g., a subsea system). As illustrated, the system 10 includes a wellhead 12 coupled to a mineral deposit 14 via a well 16, wherein the well 16 includes a wellhead hub 18 and a well-bore 20. The wellhead hub 18 includes a large diameter hub at the end of the well-bore 20 that enables the wellhead 12 to couple to the well 16. The wellhead 12 typically includes multiple components that control and regulate activities and conditions associated with the well 16. For example, the wellhead 12 includes a casing spool 22 (e.g., tubular), a tubing spool 24 (e.g., tubular), a hanger 26 (e.g., a tubing hanger or a casing hanger), and a blowout preventer (BOP) 28.

In operation, wellhead 12 enables completion and workover procedures, such as the insertion of tools (e.g., the hanger 26) into the well 16 and the injection of various chemicals into the well 16. Further, minerals extracted from the well 16 (e.g., oil and natural gas) may be regulated and routed via the wellhead 12. For example, the blowout preventer (BOP) 28 may include a variety of valves, fittings and controls to prevent oil, gas, or other fluid from exiting the well 16 in the event of an unintentional release of pressure or an overpressure condition.

As illustrated, the casing spool 22 defines a bore 30 that enables fluid communication between the wellhead 12 and the well 16. Thus, the casing spool bore 30 may provide access to the well bore 20 for various completion and workover procedures. For example, after drilling, the tubing hanger 26 may be inserted into the wellhead 12 and disposed in the casing spool bore 30. In order to couple the tubing hanger 26 to the casing spool 22, a load shoulder 32 (e.g., annular load shoulder) may be inserted into and coupled to the casing spool bore 30. Once coupled, the load shoulder 32 provides a ledge or landing surface 33 for the tubing hanger 26 to rest on. In order to couple the load shoulder 32 to the casing spool 22, the mineral extraction system 10 may include a shoulder setting tool 34 that couples to a drill string 36. In operation, the drill string 36 lowers the load shoulder system 38 into wellhead 12, which includes the load shoulder 32 and the shoulder setting tool 34. Once in place, the shoulder setting tool 34 energizes the load shoulder 32, which couples the load shoulder 32 to the casing spool 22. As explained above, the ability to couple the load shoulder 32 to the wellhead 12, after drilling operations, maximizes use of the casing spool bore 30 to receive drilling equipment during drilling operations, while still providing a hanger landing for the tubing hanger once drilling operations stop.

Figure 2:
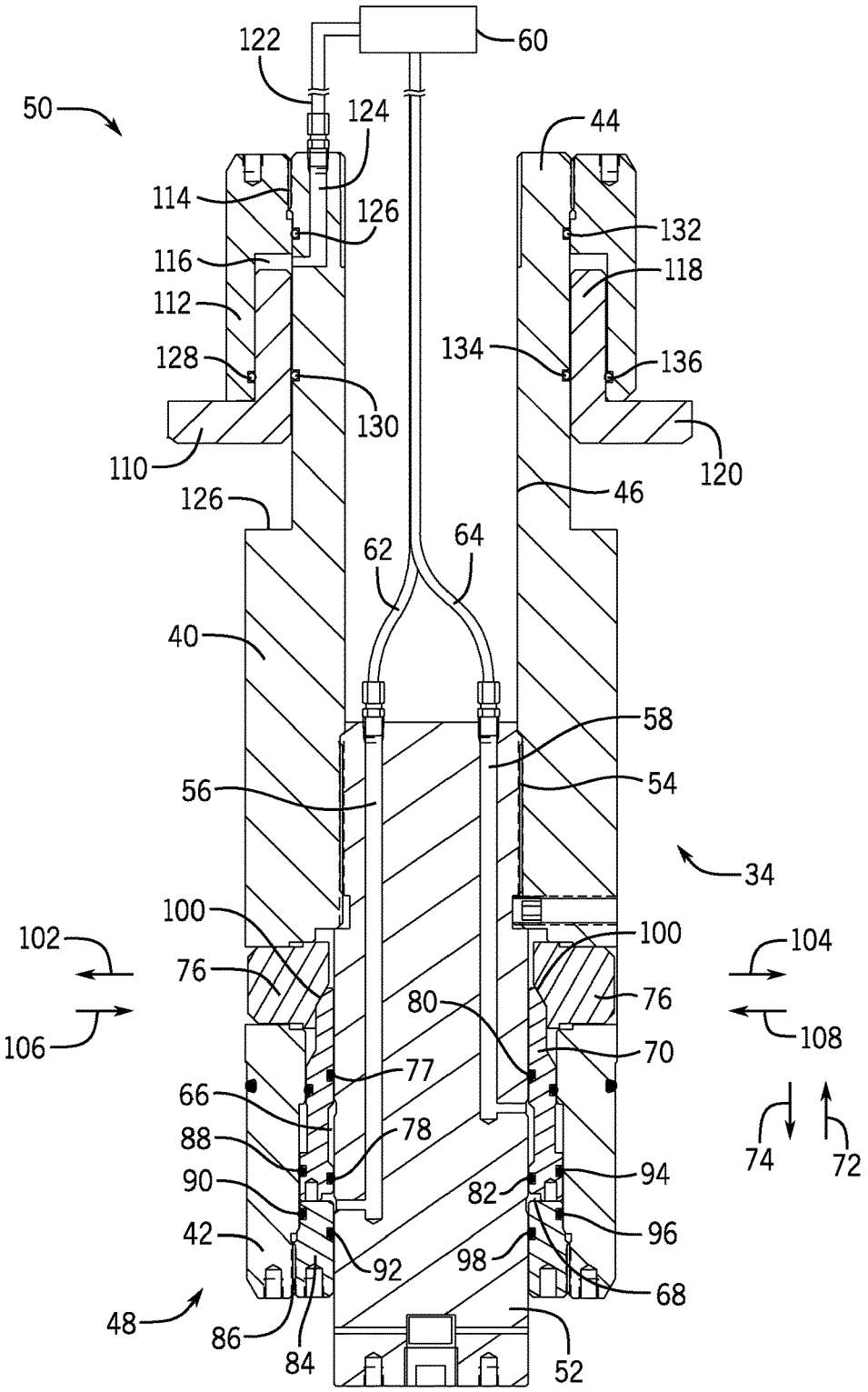
FIG. 2 is a cross-sectional side view of an embodiment of a shoulder setting tool.

FIG. 2 is a cross-sectional side view of an embodiment of the shoulder setting tool 34. As illustrated, the shoulder setting tool 34 includes a tool body 40 (e.g., tubular tool body) with a first end 42, a second end 44, and an axial bore 46 extending axially between the first and second ends 42, 44. The shoulder setting tool 34 includes a shoulder coupling system 48 at the first end 42 and a shoulder energizing system 50 at the second end 44. Together these systems enable the shoulder setting tool 34 to couple to, energize, and release from the load shoulder 32, seen in FIG. 1. Specifically, the shoulder setting tool 34 uses the shoulder coupling system 48 to couple to the load shoulder 32. This enables the shoulder setting tool 34 to lower the load shoulder 32 into the wellhead 12. After insertion into the wellhead 12, the shoulder setting tool 34 energizes the load shoulder 32 with the shoulder energizing system 50, which locks the load shoulder 32 within the wellhead 12. The shoulder coupling system 48 then uncouples from the load shoulder 32, enabling the shoulder setting tool 34 to retract from the wellhead 12.

As illustrated, the shoulder coupling system 48 (e.g., hydraulic axial drive or hydraulic axial actuator) includes a hydraulic block 52 that threadingly couples to the tool body 40, within the bore 46, with threads 54. In some embodiments, the hydraulic block 52 may couple to the tool body 40 without threads (e.g., bolts, pins, latches, lock rings, locking dogs, etc.). The hydraulic block 52 includes two or more hydraulic passages 56 and 58 that fluidly couple to a hydraulic source 60 with hydraulic lines 62 and 64. In operation, the hydraulic passages 56 and 58 enable hydraulic fluid to pass through the hydraulic block 52 and into respective cavities 66 and 68 to drive a piston 70 (e.g., annular piston). For example, as fluid enters cavity 68, the fluid pressure drives the piston 70 in axial direction 72 (e.g., without rotation), while fluid entering cavity 66 drives the piston 70 in direction 74. The movement of the piston 70 in axial directions 72 and 74 drives radial pistons 76 (e.g., radial dogs or radial locks) radially outward as well as enabling the radial pistons 76 to retract. As will be explained in more detail below, the movement of the radial pistons 76 in and out of the tool body 40 enables the shoulder setting tool 34 to couple and uncouple from the load shoulder 32.

As illustrated, the cavity 66 is formed between the hydraulic block 52 and the piston 70. In order to seal the cavity 66, the shoulder setting tool 34 may include multiple seals. For example, the shoulder setting tool 34 may include seals 77 and 78 (e.g., annular seals) that rest within respective grooves 80 and 82 (e.g., annular grooves) on the piston 70. In some embodiments, the seals 77 and 78 may rest within grooves 80 and 82 (e.g., annular grooves) on the hydraulic block 52 or a combination of grooves on the hydraulic block 52 and the piston 70.

The cavity 68 is formed circumferentially between hydraulic block 52 and the tool body 40, and axially between the piston 70 and a retaining ring 84. As illustrated, the retaining ring 84 couples to the tool body 40 with threads 86 in order to retain the piston 70 within bore 46. In order to seal the cavity 68, there are multiple seals 78, 88, 90, and 92 (e.g., annular seals) that rest within respective grooves 82 and 94 (e.g., annular grooves) on the piston 70 and grooves 96 and 98 (e.g., annular grooves) on the retaining ring 84. In some embodiments, the grooves 82 and 98 may be on the hydraulic block 52, and grooves 94 and 96 may be on the tool body 40, or a combination thereof.

As explained above, fluid entering the cavities 66 and 68 drives the piston 70 in axial directions 72 and 74. The movement of the piston 70 in axial direction 72 and 74 enables the shoulder coupling system 48 to drive radial pistons 76 (e.g., radial dogs) outward and into contact with the load shoulder 32, as well as retract the radial piston 76 enabling the shoulder setting tool 34 to disengage from the load shoulder 32. For example, as fluid enters the cavity 68, the pressure of the hydraulic fluid drives the piston 70 in axial direction 72. As the piston 70 moves in direction 72, a first cylindrical angled surface 99 on the piston 70 contacts and slides past a rear cylindrical angled surface 100 on the radial pistons 76, which drives the radial pistons 76 radially outward in directions 102 and 104. In some embodiments, the piston 70 may continue to slide past the radial pistons 76 until a second cylindrical angled surface 105 contacts the rear cylindrical angled surface 100 on the radial pistons 76, which secures the radial pistons 76 in place. To retract the radial pistons 76, hydraulic fluid is pumped into the cavity 66, which drives the piston 70 in direction 74 enabling the radial piston 76 to retract in directions 106 and 108.

As illustrated, the shoulder energizing system 50 (e.g., hydraulic axial drive or hydraulic axial actuator) couples to a second end 44 of the shoulder setting tool 34. In operation, the shoulder energizing system 50 energizes the load shoulder 32 (e.g., annular load shoulder) to couple the load shoulder 32 to a component in the wellhead 12 (e.g., casing spool 22). The shoulder energizing system 50 includes a piston 110 (e.g., annular piston) and a sleeve 112 (e.g., annular sleeve) that circumferentially surrounds the tool body 40. The sleeve 112 couples to the tool body 40 with threads 114 and forms a cavity 116 with the tool body 40. It is within this cavity 116 that the piston 110 is able to move axially in direction 74. The piston 110 includes a first portion 118 (e.g., annular tube portion) and second flange portion 120. As illustrated, the first portion 118 rests within the cavity 116, while the second flange portion 120 extends radially outward from the first portion 118. In operation, hydraulic fluid is pumped from the hydraulic fluid source 60 through hydraulic line 122 and into a hydraulic passage 124 in the tool body 40. The hydraulic passage 124 then directs the hydraulic fluid into the cavity 116, where the pressure of the hydraulic fluid drives the piston 110 in axial direction 74 (e.g., without rotation). In order to block separation of the piston 110 from the sleeve 112, the tool body 40 may include a ledge 126 (e.g., annular ledge). As illustrated, the ledge 126 enables the piston 110 to move within the cavity 116 while simultaneously blocking the first portion 118 of the piston 110 from completely exiting the cavity 116.

In order to seal the cavity 116, the shoulder energizing system 50 may include multiple seals 126, 128, and 130 (e.g., annular seals) that rest within respective grooves 132, 134, and 136 (e.g., annular grooves). As illustrated, seal 126 rests within a groove 132 in the tool body 40. However in some embodiments, the sleeve 112 may include the groove 132. Likewise, instead of the sleeve 112 and the tool body 40 including the respective groves 136 and 134, the piston 110 may include the grooves 134 and 136. In operation, the seals 126, 128, and 130 contain the fluid within the cavity 116 enabling the hydraulic fluid to drive the piston 110.

Figure 3:
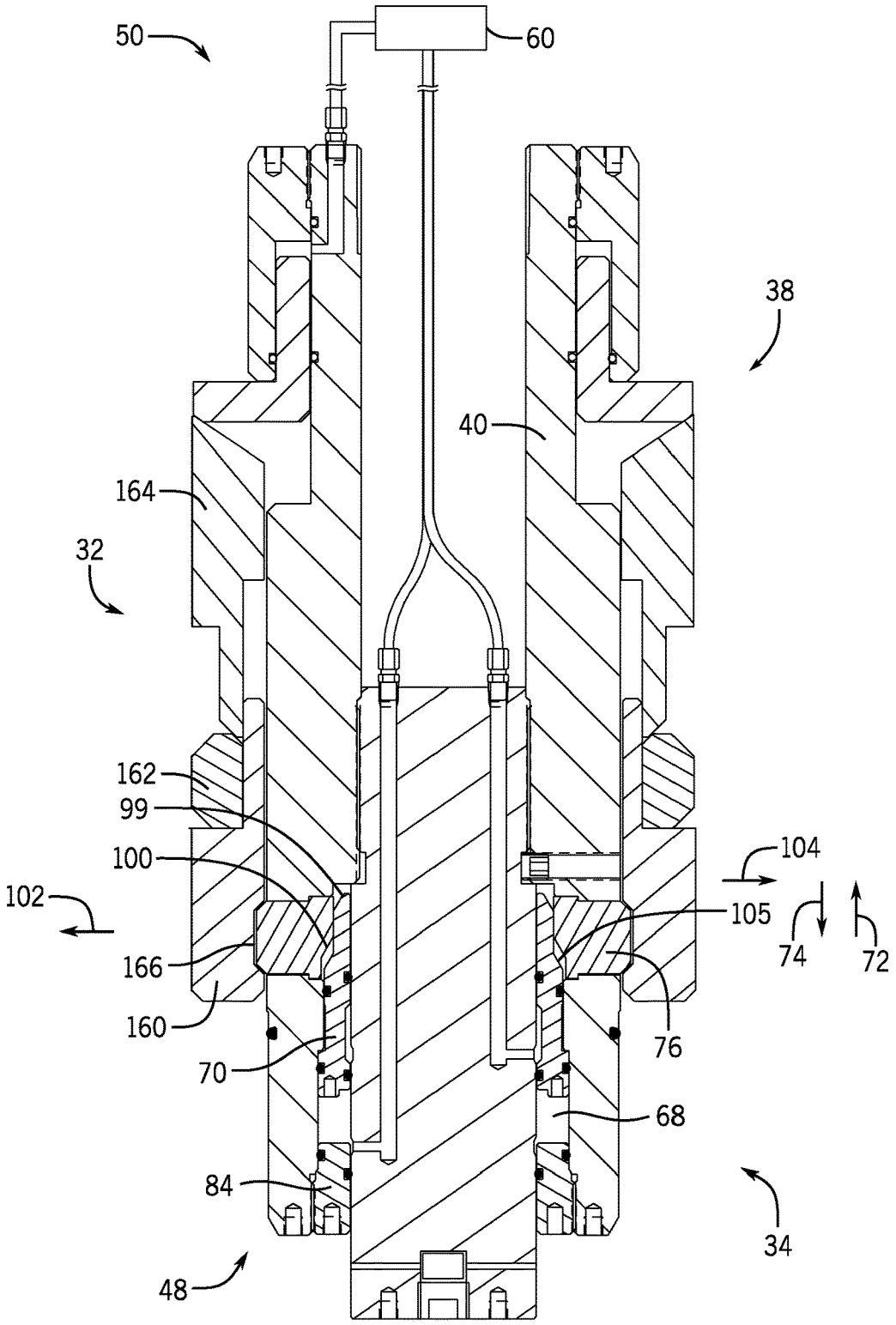
FIG. 3 is a cross-sectional side view of an embodiment of a shoulder setting tool coupled to a load shoulder.

FIG. 3 is a cross-sectional side view of an embodiment of the shoulder setting tool 34 coupled to a load shoulder 32. The load shoulder 32 includes a support ring 160, a lock ring 162 (e.g., a c-ring), and a landing ring 164. As explained above, the shoulder setting tool 34 couples to the load shoulder 32 using the shoulder coupling system 48. More specifically, as hydraulic fluid is pumped into the cavity 68 from the hydraulic fluid source 60, the hydraulic fluid drives the piston 70 in axial direction 72. As the piston 70 moves in direction 72, the piston 70 contacts and slides past the rear angled surface 100 of the radial pistons 76, which drives the radial pistons 76 radially outward in directions 102 and 104. This enables the radial pistons 76 to enter a recess 166 (e.g., annular groove) on the support ring 160, which couples the shoulder setting tool 34 to the load shoulder 32.

Figure 4:
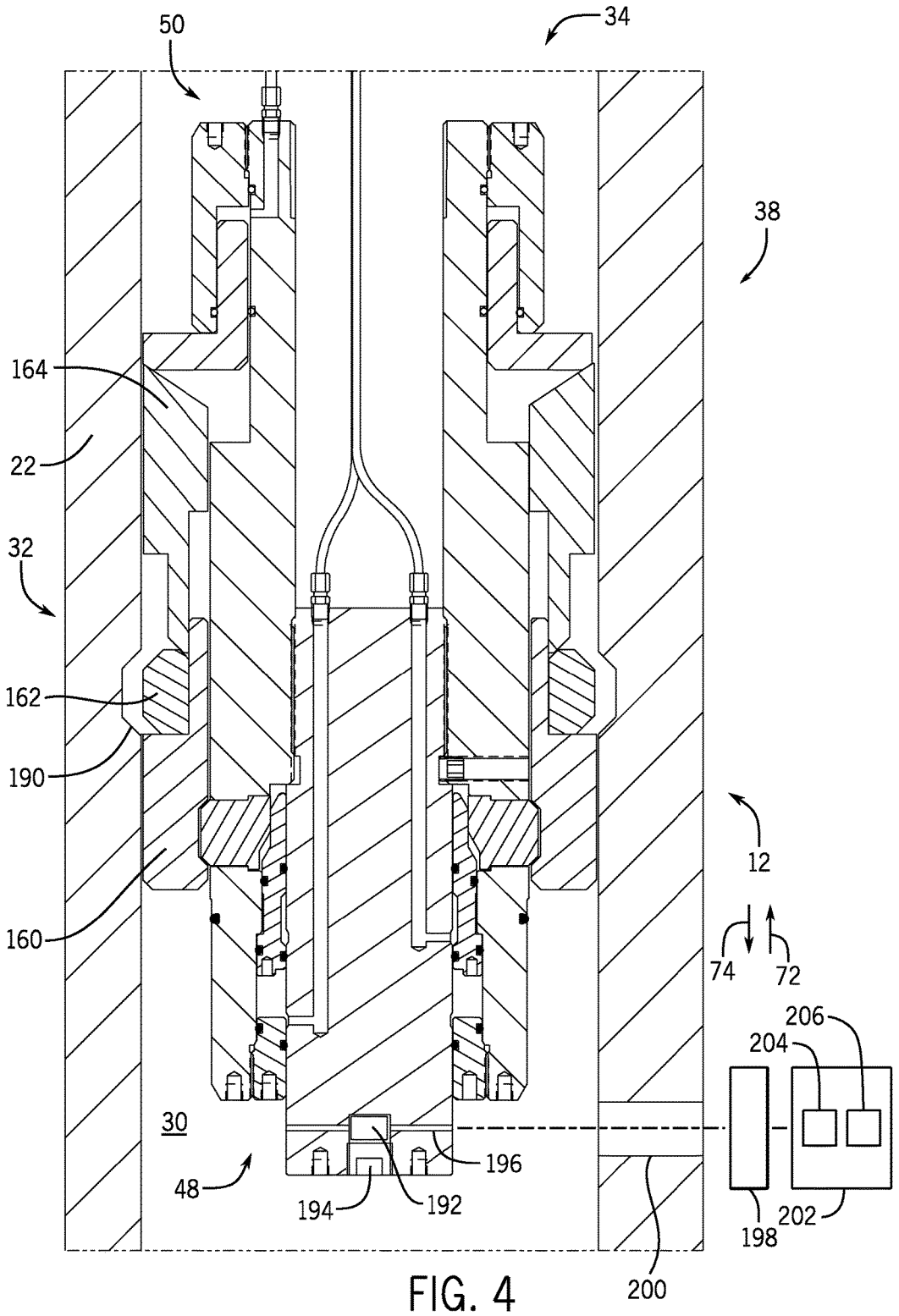
FIG. 4 is a cross-sectional side view of an embodiment of a shoulder setting tool coupled to a load shoulder in an unenergized state.

FIG. 4 is a cross-sectional side view of an embodiment of the shoulder setting tool 34 coupled to the load shoulder 32 in an unenergized state. After coupling the shoulder setting tool 34 to the load shoulder 32 (see FIG. 3), the shoulder setting tool 34 may be lowered into a wellhead component (e.g., casing spool 22). To facilitate alignment of the lock ring 162 with a corresponding recess 190 (e.g., annular groove) in the casing spool 22, the shoulder setting tool 34 may include a light emitting device 192 coupled to a power source 194 (e.g., a battery). As the shoulder setting tool 34 is lowered into the wellhead 12, the light emitting device 192 (e.g., laser unit) emits light (e.g., laser beam) that passes through an aperture 196 in the tool body 40. The light may be continuously or periodically emitted from the light emitting device 192, enabling a sensor 198 to detect the light once the shoulder setting tool 34 reaches an aperture 200. Once the sensor 198 detects light from the light emitting device 192 through the aperture 200, the mineral extraction system 10 may stop movement of the shoulder setting tool 34 in axial direction 74, thus aligning the lock ring 162 with the recess 190. In some embodiments, a controller 202 may control movement of the shoulder setting tool 34 in response to light detection by the sensor 198. For example, the controller 220 may couple to the sensor 198 and to the mineral extraction system 10. As the sensor 198 detects light from the light emitting device 192, a processor 204 in the controller 202 may execute instructions stored by the memory 206 to stop movement of the shoulder setting tool 34. In some embodiments, the device 192 may be a proximity sensor, wireless device, magnetic device, etc. that facilitates alignment of the lock ring 162 with the recess 190. In still other embodiments, the exact distance from the surface to the recess 190 may be known, enabling the shoulder setting tool 34 to be lowered to a proper position within the wellhead 12 without the controller 202 and the sensor 198.

Figure 5:
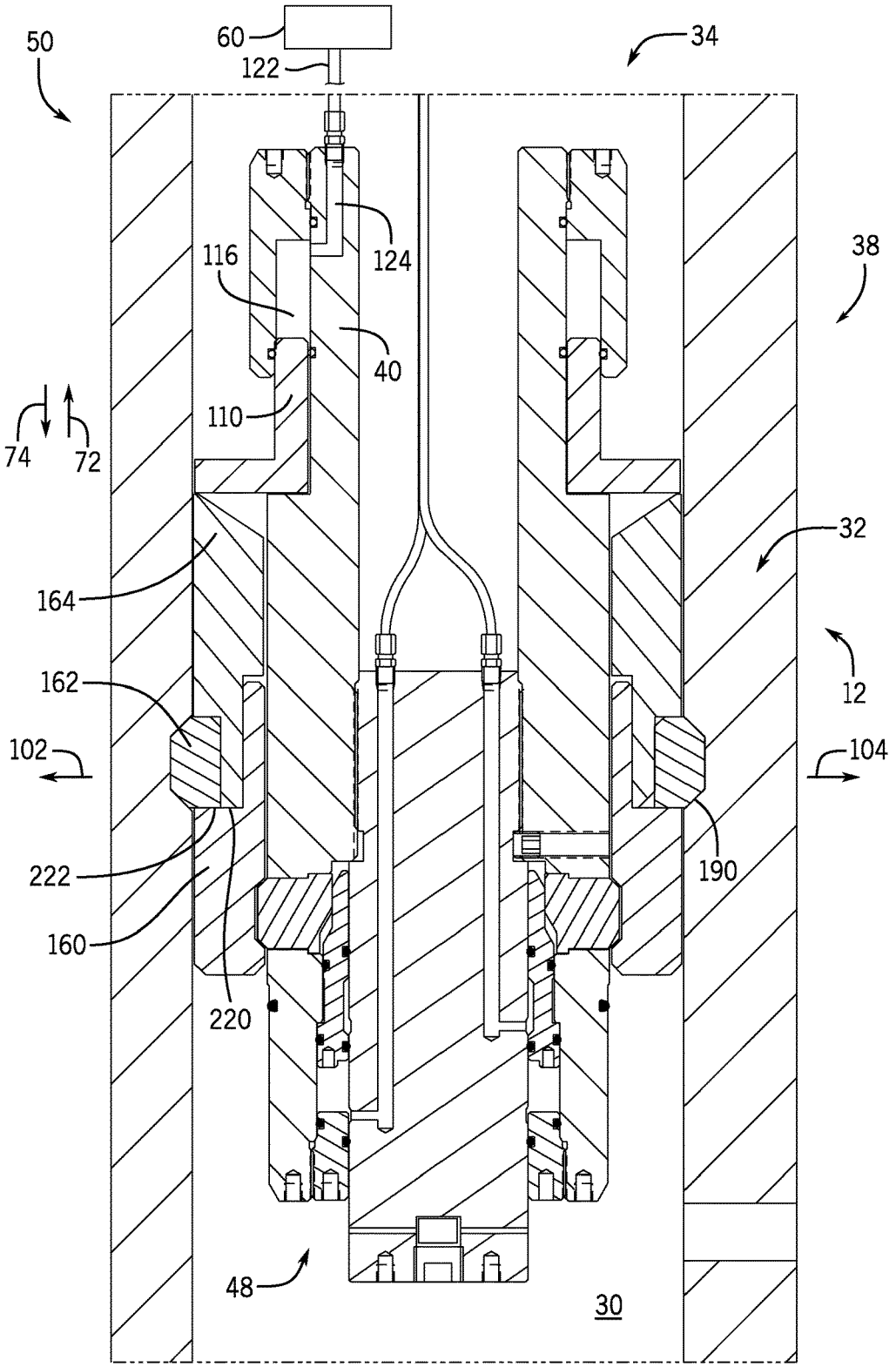
FIG. 5 is a cross-sectional side view of an embodiment of a shoulder setting tool energizing a load shoulder.

FIG. 5 is a cross-sectional side view of an embodiment of the shoulder setting tool 34 coupled to a load shoulder 32 in an energized state. Once the shoulder setting tool 34 is lowered into the proper position within the wellhead 12 (see FIG. 4), the shoulder energizing system 50 energizes the load shoulder 32. As explained above, hydraulic fluid is pumped from the hydraulic fluid source 60 through hydraulic line 122 into a hydraulic passage 124 in the tool body 40. The hydraulic passage 124 then directs the hydraulic fluid into the cavity 116, where the pressure of the hydraulic fluid drives the piston 110 in direction 74. As the piston 110 moves in direction 74, the piston 110 drives the landing ring 164 between the lock ring 162 and the support ring 160. The axial movement of the landing ring 164 thereby drives the lock ring 162 radially outward in directions 102 and 104 and into the recess 190. The landing ring 164 may continue to move in axial direction 74 until an end surface 220 contacts a ledge 222 on the support ring 160. In this position, the load shoulder 32 is an energized state and coupled to the casing spool 22.

Figure 6:
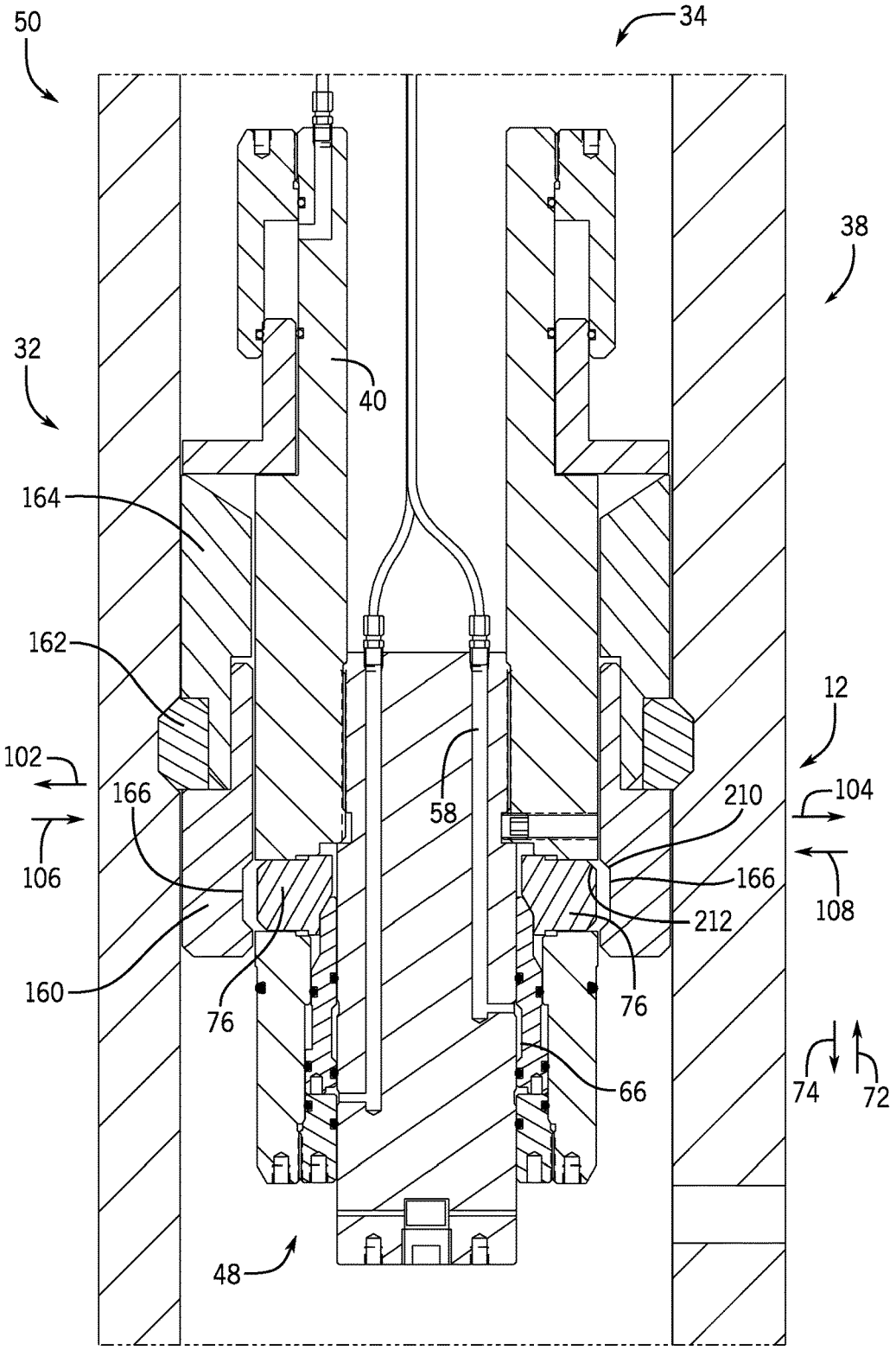
FIG. 6 is a cross-sectional side view of an embodiment of a shoulder setting tool uncoupling from a load shoulder.

FIG. 6 is a cross-sectional side view of the shoulder setting tool 34 uncoupling from a load shoulder 32. As explained above, the shoulder setting tool 34 uncouples from the load shoulder 32 using hydraulic fluid that actuates piston 70 in the shoulder coupling system 48. Specifically, hydraulic fluid is pumped into the cavity 66, which drives the piston 70 in axial direction 74. As the piston 70 moves in direction 74, the piston 70 provides the space for the radial pistons 76 to retract into the tool body 40. For example, after movement of the piston 70 in direction 74, the shoulder setting tool 34 may retract in axial direction 72. As the shoulder setting tool 34 moves in direction 72, the angled lip 210 of the recess 166 contacts the angled surface 212 of the radial pistons 76 forcing the radial pistons 76 radially inward in direction 106 and 108. In some embodiments, the shoulder coupling system 48 may also include a spring that automatically retracts the radial pistons 76, after the piston 70 moves in axial direction 74. Once the radial pistons 76 retract, the shoulder setting tool 34 can be withdrawn from the wellhead 12.

Figure 7:
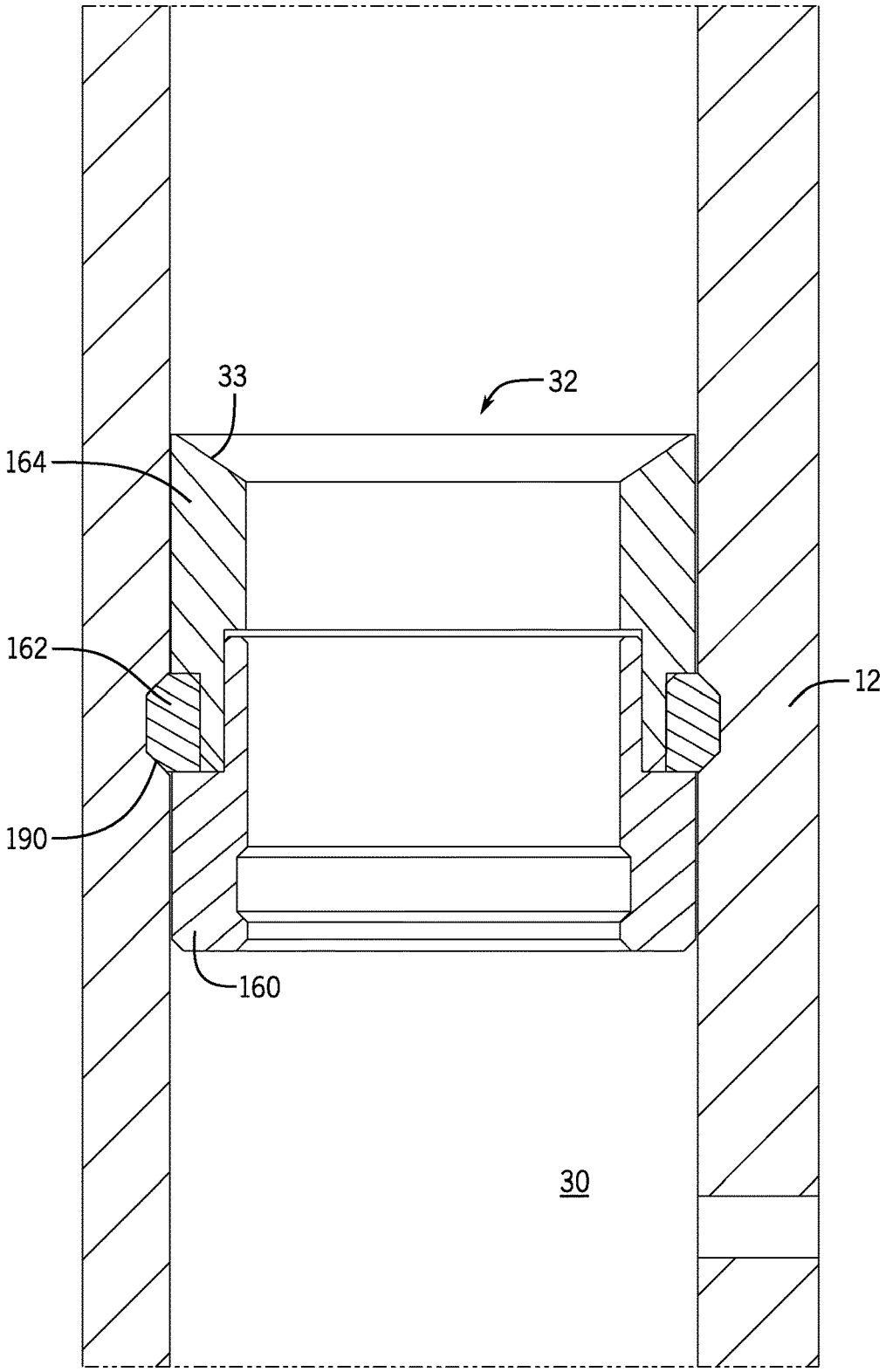
FIG. 7 is a cross-sectional side view of an embodiment of a load shoulder coupled to a tubular.

FIG. 7 is a cross-sectional side view of the load shoulder 32 coupled to the casing spool 22. As illustrated, the load shoulder 32 is in an energized state with lock ring 162 engaged with the recess 190 in the casing spool 22. In this position, the load shoulder 32 is able to support a casing hanger or other pieces of equipment on a landing shoulder surface 33.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system, comprising:

a shoulder setting tool configured to set a load shoulder, wherein the shoulder setting tool comprises:

a shoulder coupling system comprising a first piston configured to move in a first axial direction to drive one or more radial locks in a first radial direction to couple with a support portion of the load shoulder; and a shoulder energizing system comprising a second piston configured to move in a second axial direction opposite the first axial direction to cause a lock portion of the load shoulder to move in a second radial direction into a groove in a tubular of a mineral extraction system, wherein the load shoulder is configured to land a component on a landing portion and transfer a load of the component to the tubular through the lock portion.

2. The system of claim 1, wherein the shoulder energizing system is configured to drive the second piston to move in the second axial direction toward the one or more radial locks of the shoulder coupling system.

3. The system of claim 2, wherein the shoulder energizing system is configured to energize the lock portion axially between the support portion coupled to the shoulder coupling system via the one or more radial locks and the landing portion driven by the second piston of the shoulder energizing system to move the lock portion in the second radial direction into the groove in the tubular.

4. The system of claim 3, wherein the second piston of the shoulder energizing system is configured to drive the landing portion in the second axial direction toward the lock portion and the support portion to position the landing portion at least partially radially between the lock portion and the support portion, thereby driving the lock portion in the second radial direction into the groove of the tubular.

5. The system of claim 1, comprising the load shoulder having the support portion, the lock portion, and the landing portion.

6. A system, comprising:

a shoulder setting tool configured to set a load shoulder having a support portion, a lock portion, and a landing portion, wherein the shoulder setting tool comprises:

a shoulder coupling system configured to couple to the support portion of the load shoulder; and a shoulder energizing system configured to couple the load shoulder to a tubular of a mineral extraction system by driving the lock portion radially into a groove in the tubular, wherein the shoulder energizing system is configured to energize the lock portion axially between the support portion and the landing portion to move the lock portion radially into the groove in the tubular, wherein the lock portion is positioned axially between the shoulder coupling system and the shoulder energizing system while operating the shoulder setting tool to set the load shoulder;

wherein the load shoulder is configured to land a component separate from the shoulder setting tool on the landing portion and transfer a load of the component to the tubular through the lock portion, and the shoulder energizing system is configured to couple the load shoulder to the tubular of the mineral extraction system by driving the lock portion in only one radial direction into the groove in the tubular.

* * * * *